US006668717B2

(12) United States Patent
Schneider et al.

(10) Patent No.: US 6,668,717 B2
(45) Date of Patent: Dec. 30, 2003

(54) WEB-FED ROTARY PRINTING MACHINE

(75) Inventors: Josef Schneider, Diedorf (DE); Rainer Stamme, Augsburg (DE); Godber Petersen, Augsburg (DE)

(73) Assignee: Man Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/058,570

(22) Filed: Jan. 28, 2002

(65) Prior Publication Data

US 2002/0185021 A1 Dec. 12, 2002

(30) Foreign Application Priority Data

Jan. 27, 2001 (DE) ..... 101 03 632

(51) Int. Cl.[7] ..... B41F 3/42

(52) U.S. Cl. ..... 101/182; 101/220; 101/479; 101/216; 101/247

(58) Field of Search ..... 101/180, 182, 101/184, 225, 229, 247, 349.1, 351.1, 350.1, 212, 216, 218, 219, 220, 221, 479, 375, 486, 153

(56) References Cited

U.S. PATENT DOCUMENTS

| | | | | | |
|---|---|---|---|---|---|
| 2,444,547 | A | * | 7/1948 | Whitehead | 101/221 |
| 3,559,572 | A | * | 2/1971 | Hackley | 101/350.1 |
| 3,792,658 | A | * | 2/1974 | Shore et al. | 101/247 |
| 3,889,596 | A | * | 6/1975 | Thomas et al. | 101/247 |
| 4,141,293 | A | | 2/1979 | Corse | 101/181 |
| 4,488,483 | A | | 12/1984 | Kohara | 101/350 |
| 4,499,826 | A | * | 2/1985 | Regge | 101/181 |
| 4,864,927 | A | * | 9/1989 | Niehaus | 101/181 |
| 4,909,148 | A | | 3/1990 | George | 101/178 |
| 4,991,503 | A | * | 2/1991 | Morner | 101/153 |
| 5,370,047 | A | * | 12/1994 | Compton | 101/216 |
| 6,041,707 | A | | 3/2000 | Petersen et al. | 101/232 |
| 6,085,650 | A | | 7/2000 | Petersen | 101/220 |
| 6,101,940 | A | * | 8/2000 | Huff | 101/349.1 |
| 6,125,752 | A | * | 10/2000 | Freddo et al. | 101/182 |
| 6,142,073 | A | * | 11/2000 | Zeman et al. | 101/216 |
| 6,186,068 | B1 | * | 2/2001 | Gelbart | 101/486 |
| 6,276,271 | B1 | * | 8/2001 | Busshoff | 101/375 |

FOREIGN PATENT DOCUMENTS

| | | | |
|---|---|---|---|
| DE | 195 34 651 | 3/1997 | |
| DE | 198 05 898 | 11/1999 | |
| EP | 0 113 601 | 7/1984 | B41F/13/44 |
| EP | 0 899 098 | 8/1998 | |

OTHER PUBLICATIONS

Deutscher Drucker Nr. 18/11.5.2000, "Dicoweb" by MAN Roland Druckmaschinen AG, Augsburg 2000.

* cited by examiner

*Primary Examiner*—Eugene H. Eickholt
(74) *Attorney, Agent, or Firm*—Cohen, Pontani, Lieberman & Pavane

(57) ABSTRACT

In order to provide a rotary printing machine for direct printing, in which the printing-assembly cylinders are arranged in a space-saving way, there is arranged in side walls at least one double printing assembly containing two form cylinders which are located one above the other, each having its own drive motor and between which at least one impression cylinder is arranged, a web being printable between a form cylinder and an impression cylinder. Each form cylinder and the impression cylinder cooperating with the latter are mounted, adjustably in terms of their mutual spacing, in side walls of the printing unit. For this purpose, the adjustable cylinders are mounted on both sides in slides which are moveable on guide elements fastened to the side walls.

20 Claims, 8 Drawing Sheets

WEB-FED ROTARY PRINTING MACHINE

BACKGROUND OF THE INVENTION

1. Field of the Invention

The invention relates to a web-fed rotary printing machine with at least one printing unit having at least one printing assembly which contains, arranged one above the other, a forme cylinder and an impression cylinder.

2. Description of the Related Art

DE 195 34 651 A1 shows a printing assembly for a rotary printing machine for indirect printing. Four printing-assembly cylinders are arranged one above the other, the journal mountings of which are capable of being clamped in jaws which are mounted moveably on side walls by means of slides. The cylinders are accessible on the end face through an orifice in the side wall after the jaws have been moved away. The cylinders can then be equipped with sleeves of different outside diameter. This design involves relatively complicated construction.

According to U.S. Pat. No. 6,085,650, printing-assembly cylinders are mounted in slides which are displaceable on columns. Here, in each case, two cylinders can be positioned in such a way that they cooperate in direct intaglio printing. The columns must have sturdy dimensioning in order to achieve high stability.

The brochure "Dicoweb" from MAN Roland Druckmaschinen AG, Augsburg, 2000, shows printing units of a web-fed rotary printing machine, in which printing-assembly cylinders of a double printing assembly for rubber-to-rubber offset printing are mounted on both sides in slides. The slides are displaceable on guides which are fastened in each case to opposite panels of an aperture in side walls.

SUMMARY OF THE INVENTION

The object of the invention is to provide a rotary printing machine for direct printing which arranges the printing-assembly cylinders in a space-saving way.

According to the invention, each printing unit includes a pair of side walls, and at least one double-printing assembly comprising two forme cylinders arranged one above the other, each forme cylinder being driven by its own drive motor, and at least one impression cylinder arranged between the forme cylinders so that a web can be printed between one of the impression cylinders and each of the forme cylinders, each cylinder having a pair of opposed ends. The mutual spacing between the impression cylinder and the forme cylinders can be adjusted by means of slides on which both ends of at least one of the forme cylinders and the impression cylinder are mounted, the slides being moveable on guide elements fastened to the side walls. By virtue of two forme cylinders being arranged on one or two impression cylinders, a compact printing unit with a plurality of printing positions is provided in a space-saving way.

Owing to the printing-assembly cylinders being mounted on the panels of the apertures in the side walls, a direct vertical introduction of the supporting forces for the printing-assembly cylinders into the side walls in their longitudinal direction takes place. The support therefore has high rigidity and low vibration, this being a precondition for a good print quality. High forces can be applied. The device is simple in structural terms and can consequently be set up cost-effectively. Thus, for example, the guide elements can be produced with commercially available straight guides. Printing can be carried out selectively by the intaglio printing or flexographic printing method on one and the same printing machine, and the machine can be changed over in a simple way from one method to the other. Also, both printing methods may be employed simultaneously. The printing machine manufacturer can produce the machines for both methods identically from the same components, thus making cost-effective manufacture possible. Moreover, the printing machines can be designed with a variable format, that is to say they can be converted in a simple way to different formats, that is to say different diameters of the forme cylinders and cut-off lengths. Furthermore, this printing machine can be changed over quickly to various production variants.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
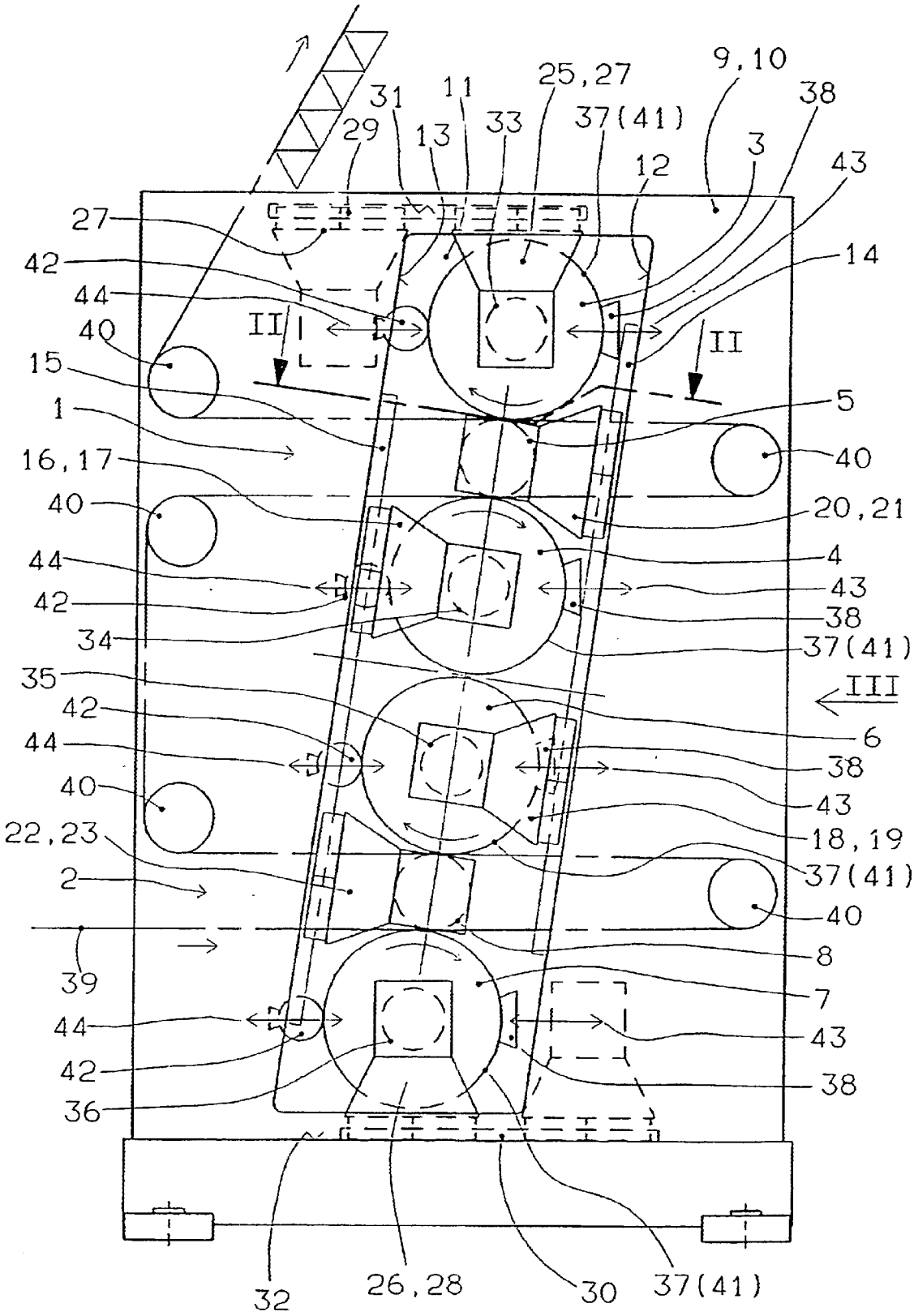
FIG. 1 shows a printing unit with two double printing assemblies in a side view.

FIG. 1 shows a printing unit of a web-fed rotary printing machine with two double printing assemblies 1, 2. The double printing assembly 1 contains two forme cylinders 3, 4, between which an impression cylinder 5 is arranged. The double printing assembly 2 contains two forme cylinders 6, 7, between which an impression cylinder 8 is arranged. All the forme cylinders 3, 4, 6, 7 and impression cylinders 5, 8 are mounted on both sides in each case in a side wall 9, 10. Each side wall 9, 10 has an aperture 11 which is delimited by opposite panels 12, 13. The apertures 11 may also be designed, for example, as an open slot. Straight guide elements 14, 15 are arranged on the panels 12, 13.

Figure 2:
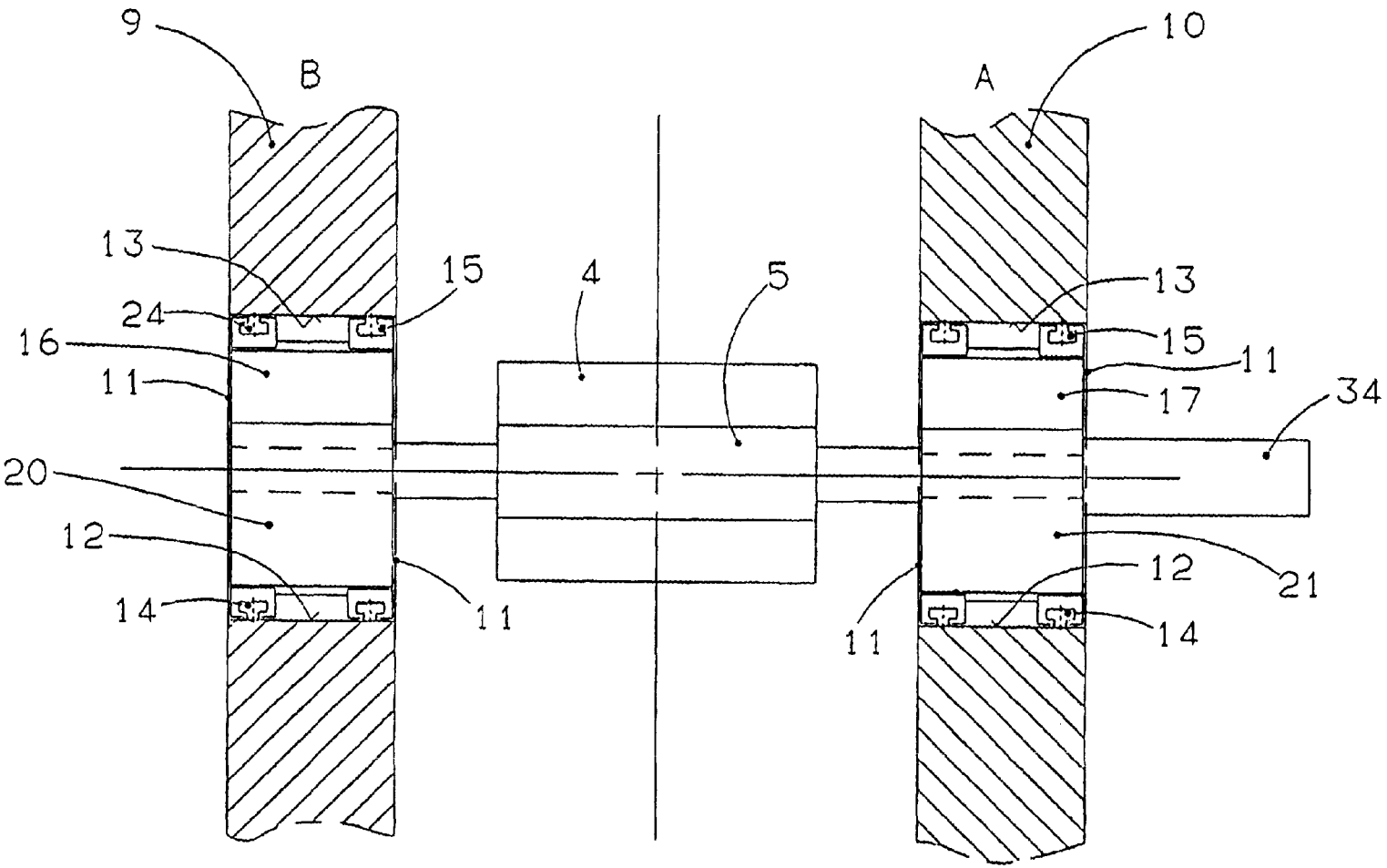
FIG. 2 shows the section II—II according to FIG. 1.

The forme cylinders 4, 6 are mounted on both sides in slides 16 to 19 which are moveable on the guide elements 15, 14. The impression cylinders 5, 8 are mounted in slides 20 to 23 which are likewise mounted moveably on the guide elements 14, 15 (FIG. 2). To provide a form-fitting slide guide, the guide elements 14, 15 have a T-shaped cross section, the crosshead of which engages into a correspondingly designed undercut channel 24 on each slide 16 to 23. For the purpose of moveability, each slide 16 to 23 possesses a threaded nut which cooperates with a driveable threaded spindle mounted in the respective side wall 9, 10. These elements are not illustrated in the present application. They are described in U.S. Pat. No. 6,397,743, which is incorporated herein by reference.

Figure 3:
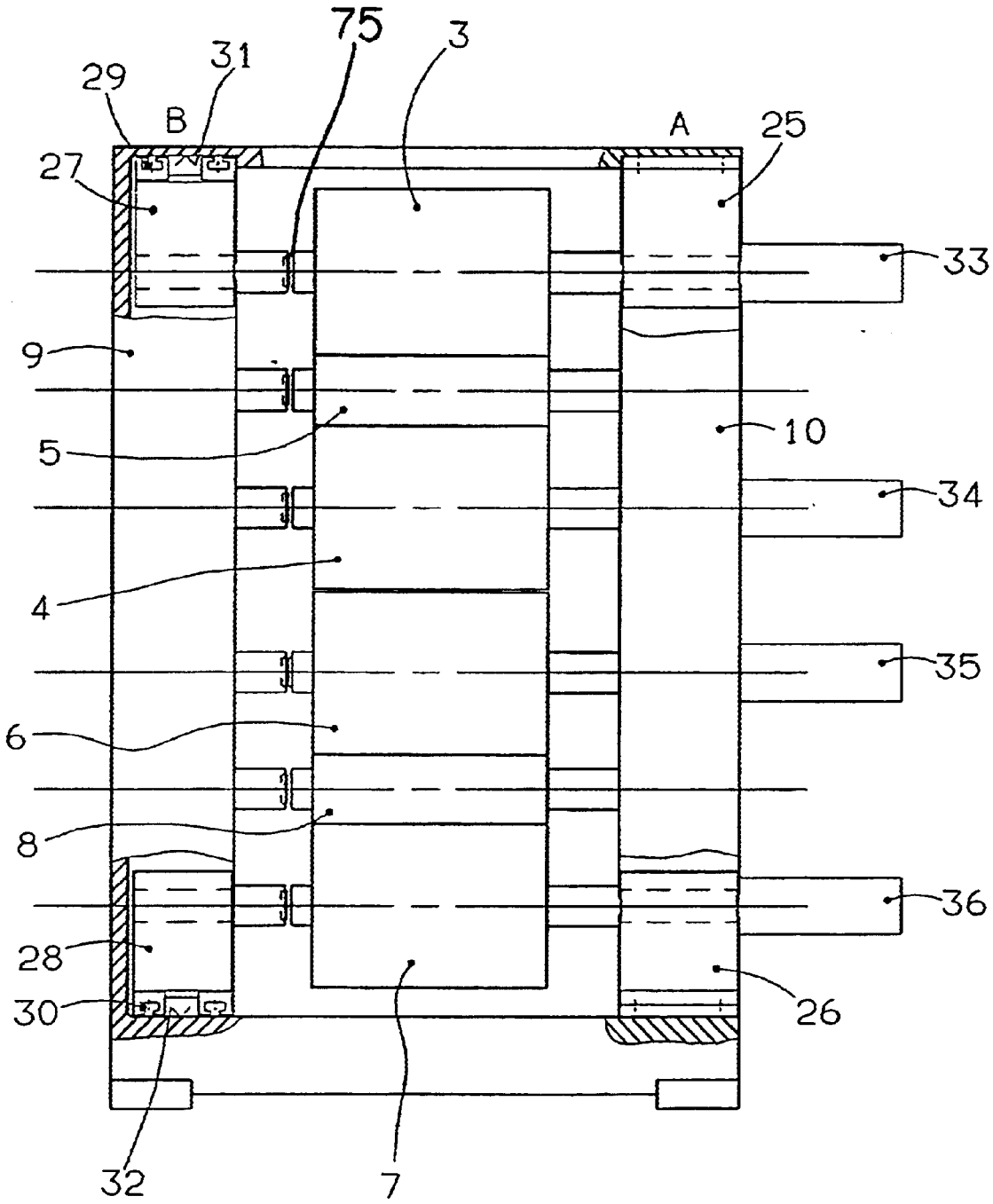
FIG. 3 shows the view III according to FIG. 1.

Referring to FIG. 3. the uppermost and lowermost forme cylinders 3, 7 are not moveable on guide elements. They are mounted, on the driving side A, in respective bearing blocks 25, 26 which are screwed to a side wall 10. On the operating side B, the forme cylinders 3, 7 are mounted in slides 27, 28 which are in each case moveable horizontally on guide elements 29, 30. The guide elements 29, 30 are fastened to panels 31, 32 of the wall 9 or of the frame of the printing unit. In order to move the slides 27, 28, the shafts carrying the uppermost forme cylinder 3 and lowermost forme cylinder 7 must first be decoupled at couplings 75, which are provided on all shafts.

The forme cylinders 3 and 4 in each case constitute, together with the impression cylinder 5, a printing assembly for the direct printing of the double printing assembly 1. They form, at the point of contact with the impression cylinder 5, in each case a printing position. The printing assembly 2 likewise possesses two printing positions at the points of contact of the forme cylinders 6 and 7 with the impression cylinder 8. Instead of one impression cylinder 5, 8, a single separate impression cylinder 5.1, 5.2, 8.1, 8.2 may also be provided for each forme cylinder 3, 4, 6, 7, as is also explained in FIG. 5. Each forme cylinder 3, 4, 6, 7 possesses, for the drive, its own motor 33 to 36, advantageously designed as a variable-position electric motor. Each forme cylinder 3, 4, 6, 7 carries a sleeve-shaped intaglio printing forme 37, onto which an intaglio inking assembly 38 can be thrown. The latter is advantageously designed as a chamber-type doctor blade.

The intaglio inking assemblies 38 thrown onto the forme cylinders 3, 4, 6, 7 driven in the direction of rotation indicated ink the respective intaglio printing forme 37. In the state in which the forme cylinders 3, 4, 6, 7 are thrown onto the impression cylinders 5, 8, a web 39 led through at the printing positions is then printed in each case. The impression cylinders 5, 8 are driven by friction. Motors for driving them may, however, also be provided. The web 39 is led approximately horizontally through the printing positions in succession, and, in each case after leaving a printing position, it is deflected by means of guide rollers 40 into the opposite direction and led into the next printing position. Finally, printed on one side in four colours, the web 39 leaves the printing unit. The throw-on and throw-off of the double printing assembly 1 are carried out by means of the displacement of the forme cylinder 4 and of the impression cylinder 5 on the guide elements 14, 15 with respect to the forme cylinder 3. The throw-on and throw-off of the double printing assembly 2 are carried out in the same way by means of the displacement of the forme cylinder 6 and of the impression cylinder 8 on the guide elements 14 and 15 with respect to the forme cylinder 7.

One intaglio printing forme 37 is changed for another intaglio printing forme 37 by the forme cylinders 3 or 7 being exposed on the operating side, its sleeve-shaped intaglio printing forme 37 being drawn off and another forme sleeve being pushed on. For this purpose, its journal is separated from the cylinder body and, remaining in the respective slide 27, 28, is moved, together with the latter, out of the circumferential region of the forme cylinder 3, 7 on the guide elements 29, 30. This position is also depicted in FIG. 1 by broken lines. The separation of the journal and the forme cylinder 3 or 7 is described in U.S. Pat. No. 6,186,065, which is incorporated herein by reference. After the printing forme 37 has been changed, the slide 27, 28 is moved into the region of the forme cylinder 3, 7 again, until the journal of the latter is in alignment with the forme cylinder 3, 7. The journals are subsequently connected to the forme cylinder 3, 7 again. The intaglio printing formes 37 of the forme cylinders 4, 6 are changed in a similar way. The operating-side journal, here, is moved out of the region of the forme cylinder 4, 6 on the guide elements 15, 14 by means of the slide 16, 18.

The printing assemblies of the printing unit according to FIG. 1 which are equipped for intaglio printing can be converted in a simple way for flexographic printing. For this purpose, in the way described, the sleeve-shaped intaglio printing forme 37 is drawn off from the respective forme cylinder 3, 4, 6, 7 and a sleeve-shaped flexographic printing forme 41 is pushed on. This conversion variant is also indicated in FIG. 1 by reference numerals given in brackets. Furthermore, in each case, a flexographic inking assembly 42 is thrown onto the forme cylinders 3, 4, 6, 7. The flexographic inking assembly 42 is advantageously designed with an engraved roller and the chamber-type doctor blade. In the change from the intaglio printing method to the flexographic printing method, a sleeve with an elastic counterpressure surface on the impression cylinder 5, 8 is advantageously changed to a sleeve with a non-elastic counterpressure surface. The change of the sleeve on the impression cylinder 5, 8 takes place in a similar way to the forme change on the forme cylinders 3, 4, 6, 7. Thus, the impression cylinder 5, 8 is exposed at the operating-side mounting, in that its journal, together with the slides 20, 22, is moved away from the region of the impression cylinder 5, 8. A printing assembly equipped for flexographic printing can also be converted to intaglio printing in the way described.

The intaglio inking assembly 38 and the flexographic inking assembly 42 of the forme cylinders 4, 6 are fastened to the associated slides 16, 17 and 18, 19. Depending on the printing method selected, the intaglio inking assembly 38 or the flexographic inking assembly 42 is suspended in the slides 16 to 19 or both inking assemblies 38, 42 are advantageously inserted into the slides 16 to 19 simultaneously. By virtue of this inking-assembly fastening, in the event of a change in the diameter of the forme cylinder 4, 6 the inking assemblies 38, 42 are also brought into the correct position at the same time as these forme cylinders 4, 6 are displaced into the new position. Furthermore, the inking assemblies 38, 42 are displaceable in an approximately horizontal direction by means of movement devices 43, 44 for diameter adaptation and for throw-on and throw-off. Since the outer forme cylinders 3, 7 are arranged, fixed in place, their inking assemblies 38, 42 are arranged in a predetermined vertical position and are displaceable only by means of the movement device 43, 44.

Figure 4:
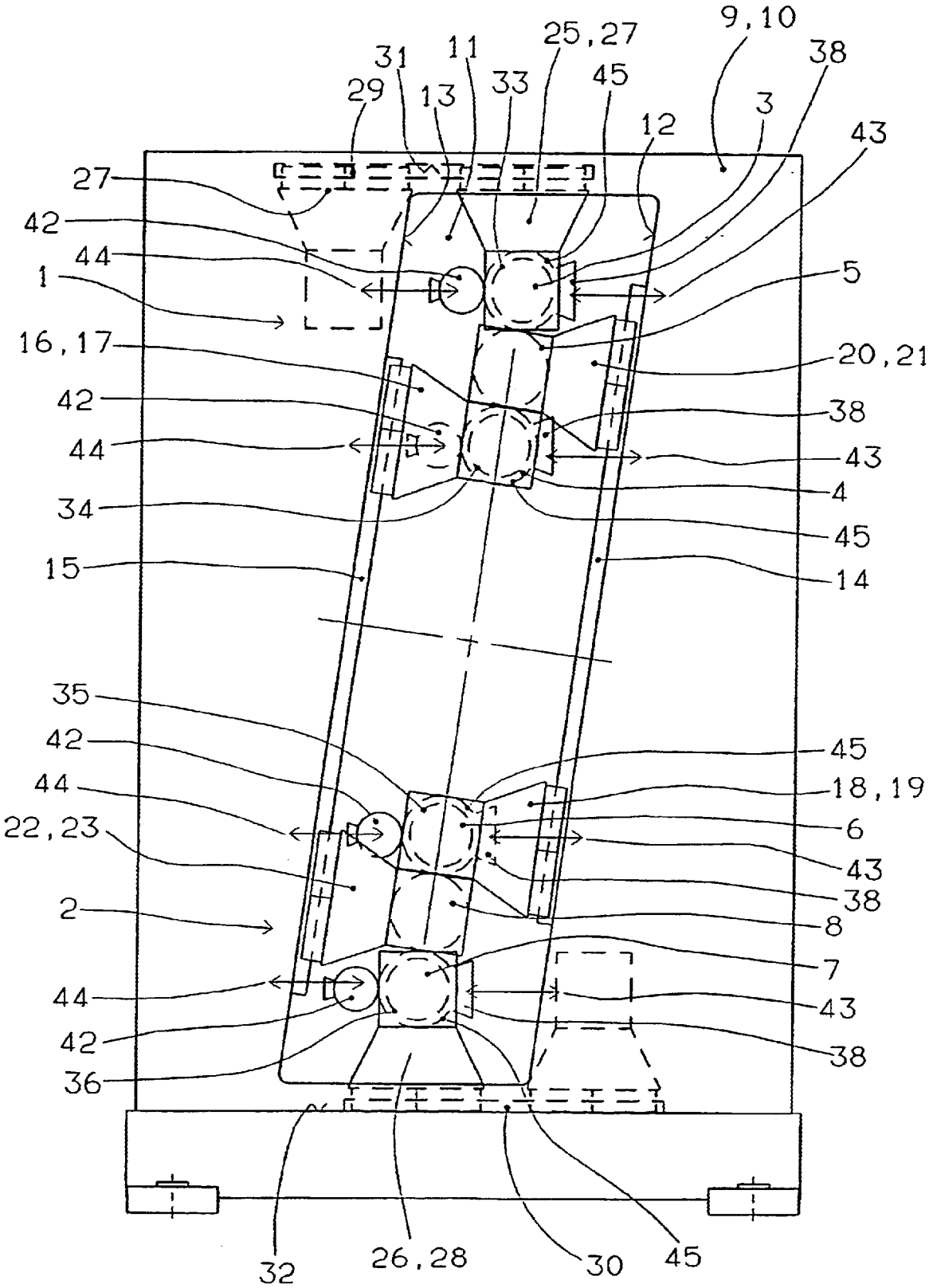
FIG. 4 shows the printing unit according to FIG. 1, but equipped with sleeve-shaped printing formes of smaller outside diameter.

The sleeve-shaped printing formes 37, 41 of the forme cylinders 3, 4, 6, 7 can also be changed for sleeve-shaped printing formes 45 having a different outside diameter. FIG. 4 shows the printing unit according to FIG. 1, but sleeve-shaped printing formes 45 of smaller diameter have been drawn onto the forme cylinder 3, 4, 6, 7. For adaptation to the smaller diameters of the forme cylinders 3, 4, 6, 7, the impression cylinder 5 has been moved towards the stationary forme cylinder 3 by means of the slides 20, 21 and the impression cylinder 8 towards the stationary forme cylinder 7 by means of the slides 22, 23. In the same way, the forme cylinder 4 has been moved towards the impression cylinder 5 by means of the slides 16, 17 and the forme cylinder 6 towards the impression cylinder 8 by means of the slides 18, 19. During these movement actions, the inking assemblies 38, 42 of the forme cylinders 4 and 6 have immediately also been brought into the necessary vertical positionings by virtue of their fastening to the slides 16, 17 and 18, 19. The adaptation of the inking assemblies 38, 42 in the horizontal direction to the smaller diameter of the forme cylinders 3, 4, 6, 7 is carried out by means of the movement devices 43, 44. The further elements identical to FIG. 1 are not indicated and explained in order to avoid repetitions.

Figure 5:
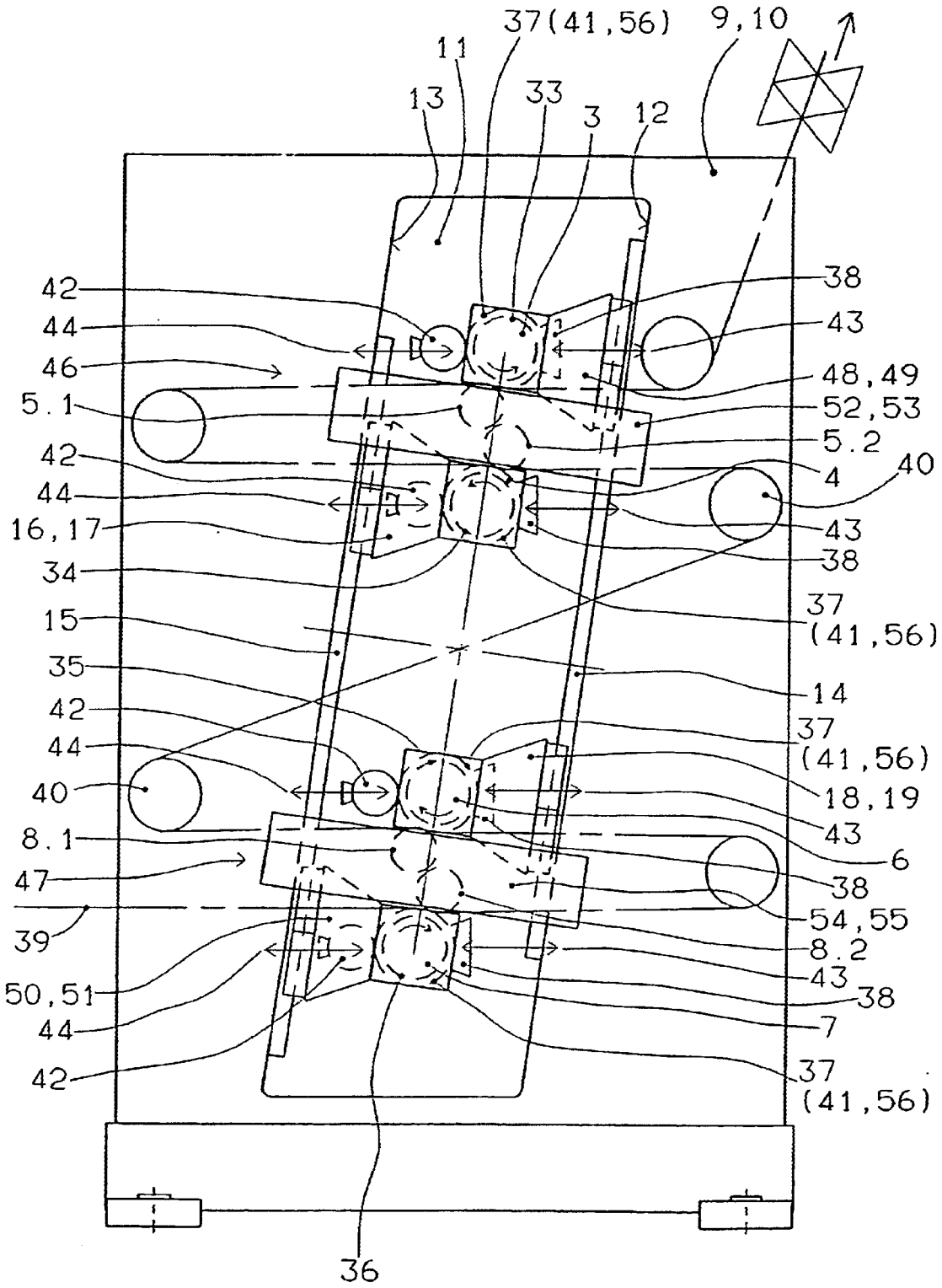
FIG. 5 shows a further design variant to FIG. 1 and FIG. 4, FIGS. 6 and 7 show a printing machine with a printing unit having only one double printing assembly with two production variants.

FIG. 5 shows a further design variant of a printing unit to FIG. 1 or FIG. 4. For the sake of simplicity, in dealing with this and further exemplary embodiments, the previous reference symbols will largely be retained for identical or similar components. FIG. 5 again shows two double printing assemblies 46, 47, each with two forme cylinders 3, 4 and 6, 7 arranged one above the other. In contrast to FIG. 1, the outer forme cylinders 3, 7 are also in each case mounted on both sides in slides 48, 49 and 50, 51 which are mounted slideably on the guide elements 14, 15. The guide elements 14, 15 are fastened in each case to the panels 12, 13 of an aperture 11 in the two side walls 9, 10. In a modification of the printing unit according to FIG. 1, two impression cylinders 5.1, 5.2 and 8.1, 8.2 are arranged between the forme cylinders 3, 4 and 6, 7 of a double printing assembly 46, 47, in each case one of these impression cylinders being assigned to a forme cylinder 3, 4, 6, 7. By virtue of the displaceable arrangement of the forme cylinders 3, 4, and 6, 7 of each double printing assembly 46, 47, it is possible, for their spacing adjustment for the purpose of print throw-on and throw-off or for varying the spacing from the impression cylinders 5.1, 5.2, 8.1, 8.2 within the framework of a format change, to arrange the impression cylinders 5.1, 5.2, 8.1, 8.2 so as to be fixed in place. They are therefore mounted on both sides in bridges 52 to 55 fastened to the side walls 9, 10. By virtue of the impression cylinders 5.1, 5.2, 8.1, 8.2 being arranged in this way so as to be fixed in place, in the event of a format change the web 39 led through the printing unit does not change its position in the vertical direction. An intaglio inking assembly 38 and a flexographic inking assembly 42 are arranged on each forme cylinder 3, 4, 6, 7 and each forme cylinder 3, 4, 6, 7 possesses its own motor 33 to 36 for the drive.

Located by way of example on each of the forme cylinders 3, 4, 6, 7 is a sleeve-shaped intaglio printing forme 37, onto which the respective intaglio inking assembly 38 is thrown. The web 39 is first led through between the forme cylinder 7 and the associated impression cylinder 8.2, subsequently deflected in its direction by means of a guide roller 40 and led through between the forme cylinder 6 and the associated impression cylinder 8.1. The web 39 is thereafter led through between the two double printing assemblies and then between the forme cylinder 4 and the associated impression cylinder 5.2 and, after being deflected around a guide roller 40, is led through between the forme cylinder 3 and the associated impression cylinder 5.1 of the upper double printing assembly 46. In this case, the web 39 is first printed on one side in two colours in the lower double printing assembly 47 and is printed in verso printing, likewise in two colours, by the upper double printing assembly 46, so that finally, printed on both sides in two colours, the web 39 leaves the printing unit. The web run shown in FIG. 1 is, of course, also possible instead, in which case the web 39 would be printed on one side in four colours. By virtue of the impression cylinder 5.1, 5.2 for the forme cylinders 3, 4 and 8.1, 8.2 for the forme cylinders 6, 7 being provided in each case, the two forme cylinders 3, 4 and 6, 7 of a double printing assembly 46, 47 can be driven individually in terms of their rotational speed, as a result of which, for example, web elongations after the first print has taken place between the forme cylinder 7 and the impression cylinder 8.2 can be counteracted during the subsequent print between the forme cylinder 6 and the impression cylinder 8.1 by means of a leading drive of the forme cylinder 6.

The printing assemblies of the printing unit illustrated in FIG. 5 can be changed over in a simple way from intaglio printing to flexographic printing in the way already described, by the sleeve-shaped intaglio printing forme 37 being drawn off from the forme cylinders 3, 4, 6, 7 and being replaced by a sleeve-shaped flexographic printing forme 41. The cylinder body carrying these printing formes 37, 41 can also be extracted from the printing assemblies and replaced by a cylinder body 56, onto the outer surface of which an intaglio or flexographic printing forme is pushed directly. These variants are also indicated in FIG. 5 by reference numerals placed in brackets. The complete forme cylinder 3, 4, 6, 7, together with its journals, may also be extracted from the printing unit and exchanged for another intaglio or flexographic printing forme cylinder. The newly introduced printing formes may even have a different outside diameter, a format change thus being carried out. The change, taking place at the same time, in the spacing between the forme cylinder 3, 4, 6, 7 and the associated impression cylinder 5.1, 5.2, 8.1, 8.2 takes place as a result of the corresponding displacement of the forme cylinders 3, 4, 6, 7 by means of the slides 48 to 51, 16 to 19.

Figure 6:
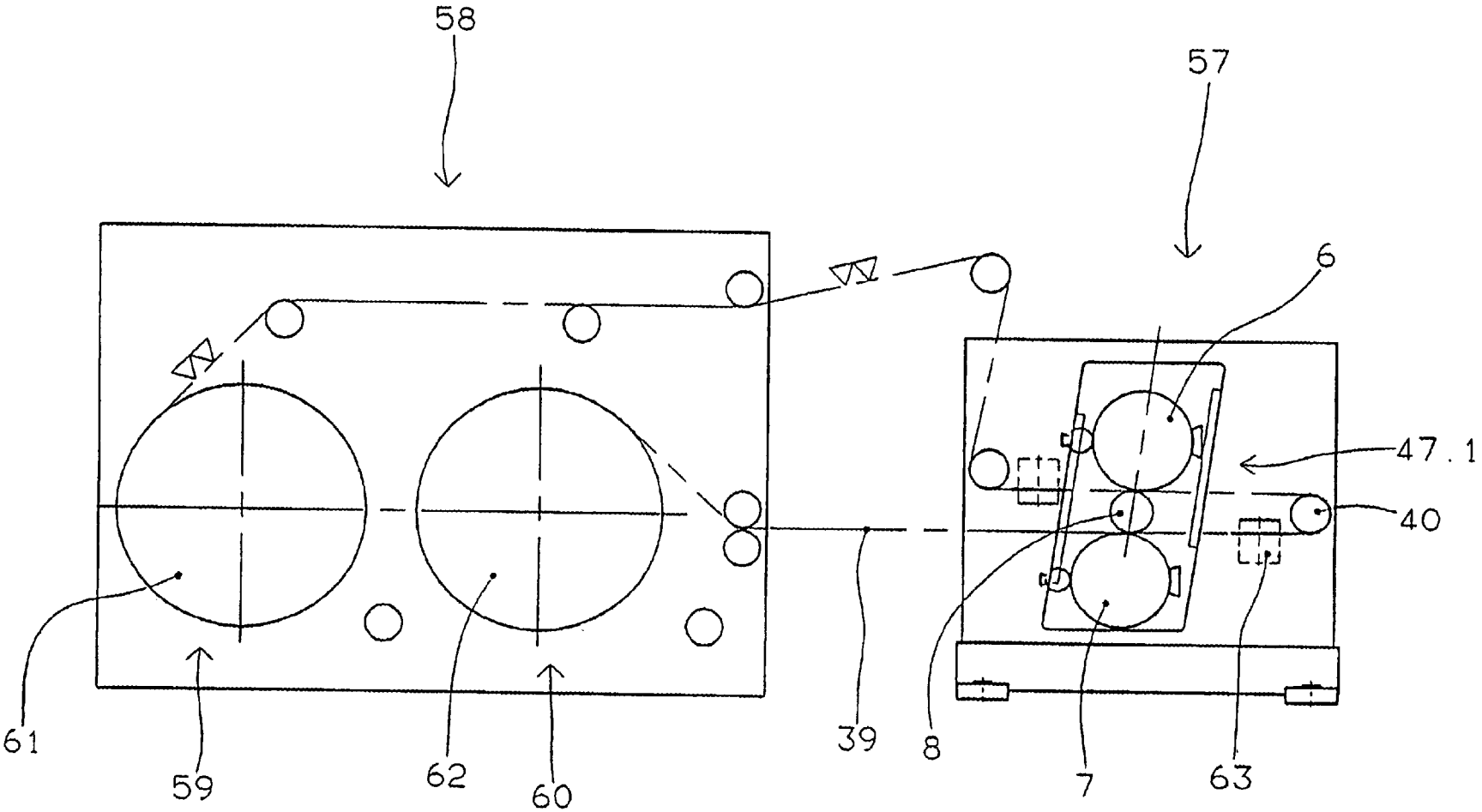
Figure 7:
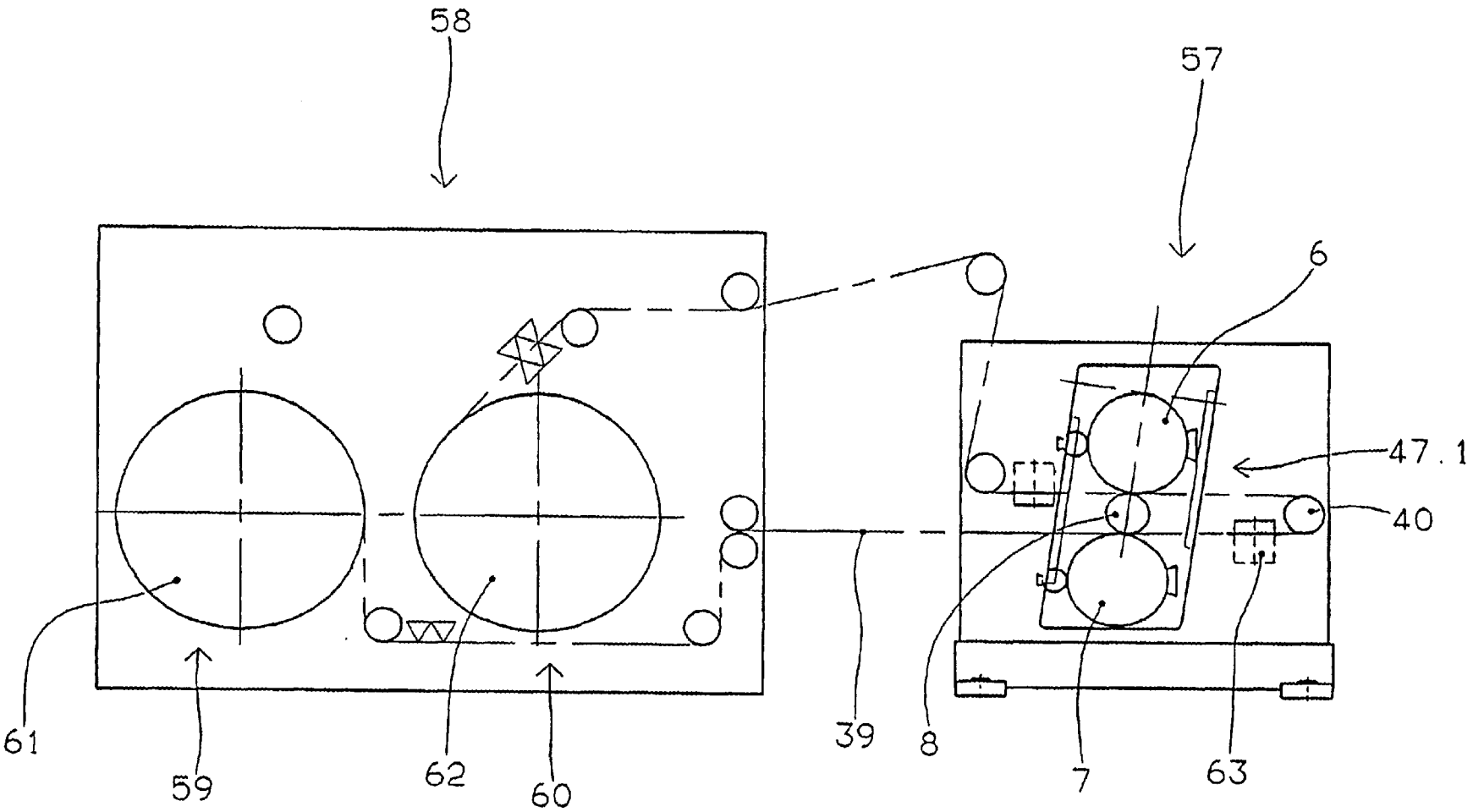

Some printing machine configurations, using the double printing assemblies described, will be presented below. FIGS. 6 and 7 show a printing machine with a printing unit 57 and with a winding device 58. As compared with the printing units described hitherto, the printing unit 57 contains only one double printing assembly 47.1 which is similar, for example, to the lower double printing assembly 47 shown in FIG. 5, and it does not matter that only one impression cylinder between the forme cylinders is depicted symbolically in FIG. 6, but, in practice, it is perfectly possible for there to be two individual impression cylinders.

The winding device 58 contains two reeling devices 59, 60, into each of which a winding wheel 61, 62 can be clamped. The reeling devices 59, 60 can operate in the unwinding and the winding-up mode.

According to FIG. 6, a web 39 is unwound from the winding reel 62 of the reeling device 60 and is supplied to the printing unit 57. There, it is first printed on one side with one colour in a first printing position between the forme cylinder 7 and the impression cylinder 8, it is subsequently deflected into the opposite direction by means of the guide roller 40 and is printed on the same side of the web with a further colour in a next printing position between the forme cylinder 6 and impression cylinder 8. The web 39 printed in two colours on one side is then led by means of further guide rollers 40 to the reeling device 59 operating in the winding-up mode and wound up onto the winding reel 61. A drying device 63 directed onto the printed side of the web 39 is advantageously arranged downstream of each printing position with the result that the print is dried before passing a guide roller 40 or a further printing position.

FIG. 7 shows the further processing of the web 39 wound up to form the winding reel 61, by means of the same web-fed rotary printing machine as that shown in FIG. 6. The web 39 printed in two colours on one side is unwound from the winding reel 61 of the reeling device 59, which is then operating in the unwinding mode, and is supplied to the printing unit 57. In this case, the web 39 runs in the way already described through the printing position between the forme cylinder 7 and the impression cylinder 8 and, after being deflected in the opposite direction, through the printing position between the forme cylinder 6 and the impression cylinder 8, the web being printed in two colours in verso printing. The web 39, then printed in two colours on each of the two sides, is supplied to the reeling device 60 operating in the winding-up mode and is wound onto the winding reel 62.

Figure 8:
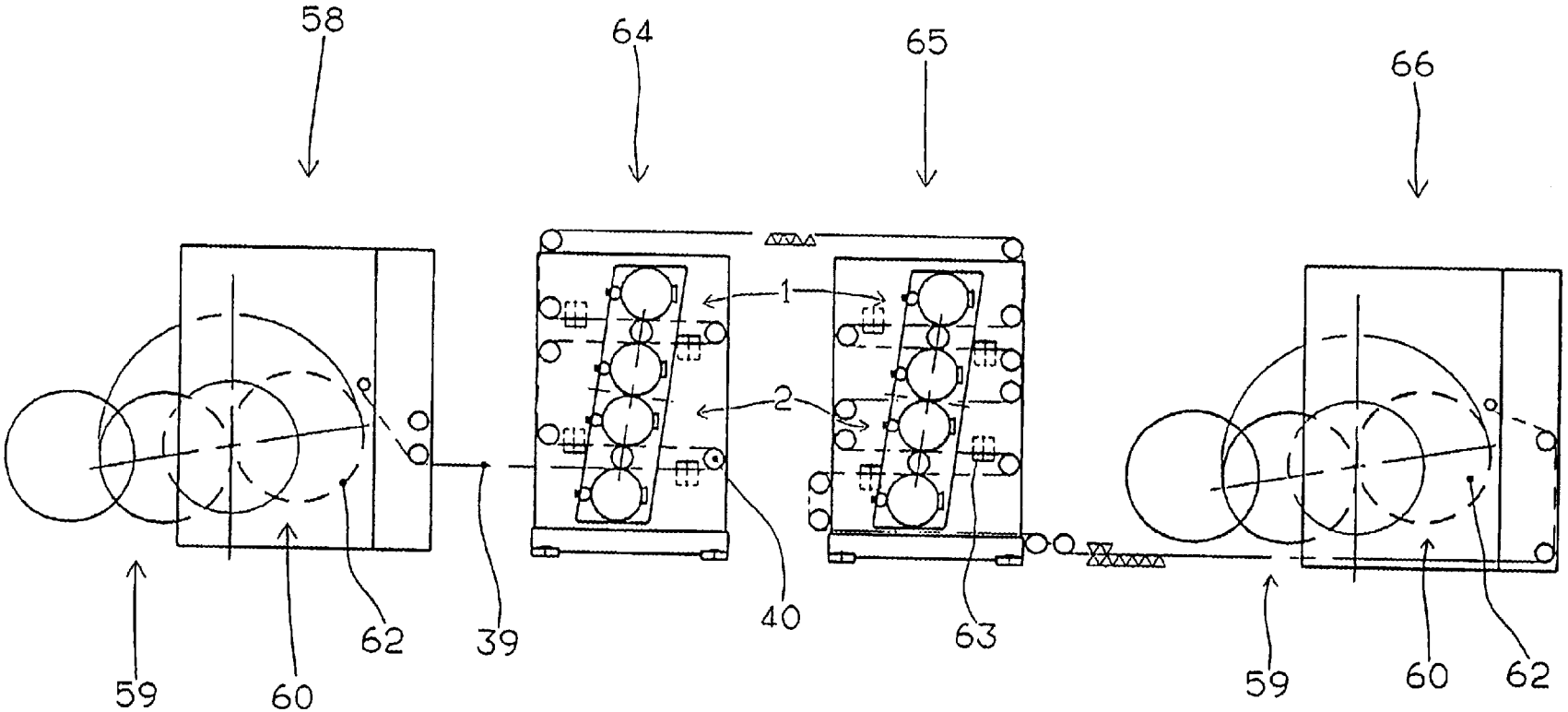
FIG. 8 shows a printing machine with two printing units, each with two double printing assemblies.

FIG. 8 shows a web-fed rotary printing machine with two printing units 64, 65 which are preceded by a winding device 58 and followed by a winding device 66. Each winding device 58, 66 contains two reeling devices 59, 60 which can be operated selectively as an unwinding or a winding-up device. Printing units 64 and 65 each contain two double printing assemblies 1, 2, as illustrated in FIG. 1 and described.

The web 39 is unwound from the winding reel 62 by the reeling device 60 of the winding device 58, said reeling device operating in the unwinding mode, and is supplied to the printing unit 64. There, the web 39 is led successively through the printing positions between a forme cylinder and an impression cylinder in each case, and, after leaving a printing position, it is deflected into the opposite direction by means of at least one or more guide rollers 40 and led into the next printing position. The web 39 is thereby printed in four colours on one side and is then supplied to the printing unit 65. There, it is led successively through the printing positions of the double printing assembly 1 in the way just described, the four-colour print on one side of the web being supplemented by two colours, that is to say a six-colour print is produced. The web 39 is subsequently led through between the double printing assemblies 1, 2 (that is to say, through between the inner forme cylinders, as shown by way of example in FIG. 5) and is thereafter led through the printing positions of the lower double printing assembly 2, the web 39 being printed in two colours in verso printing. The web thus provided with a six/two print is then supplied to the winding device 66 and wound onto the winding reel 62 in the reeling device 60 operating in the winding-up mode. A drying device 63 directed onto the printed side of the web is advantageously arranged downstream of each printing position in the web running direction, the result of this being that the fresh print is dried before passing a guide roller 40 or a further printing position.

Rotary printing machines are afforded further production possibilities by other web routings. Thus, with one printing position being omitted in the printing unit 65 of FIG. 8, for example, a print of six colours can also be made on one side of the web 39 and a print of one colour on the other side. Also, for example, in FIG. 8 the web leaving the printing unit 64 can be introduced from the left into the uppermost printing position of the printing unit 65 and then successively through the further printing positions, in each case the web 39, after leaving a printing position, being deflected into the opposite direction by means of one or more guide rollers and being led into the next printing positions. A four-colour print on both sides can be produced in this way.

In all the printing machine configurations according to FIGS. 6 to 8, a selection can be made between the intaglio and flexographic printing methods. It is also possible, for example, to use one printing method for recto printing and the other printing method for verso printing. The printed web 39, instead of being wound into reels, may also be supplied to an open-sheet delivery or delivered in sheet forme or be processed into foldable products in a folder.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A web-fed rotary printing machine comprising at least one printing unit, each said printing unit comprising a pair of side walls, and at least one double printing assembly comprising two forme cylinders arranged one above the other, each forme cylinder being driven by its own drive motor, and at least one impression cylinder arranged between said forme cylinders so that a web can be printed between said impression cylinder and each of said forme cylinders simultaneously, each said cylinder having a pair of opposed ends, and means for adjusting the mutual spacing between the impression cylinder and the forme cylinders, said means comprising slides in which both ends of at least one of said forme cylinders and said impression cylinder are mounted, said slides being moveable linearly on guide elements fastened to said side walls.

2. A web-fed rotary printing machine as in claim 1 wherein said printing unit comprises two said double printing assemblies arranged one above the other.

3. A web-fed rotary printing machine as in claim 1 wherein each said side wall has an aperture flanked by a pair of mutually facing panels, each said guide element being fastened to a respective said panel.

4. A web-fed rotary printing machine as in claim 1 wherein both forme cylinders of said double printing assembly are moveable in slides.

5. A web-fed rotary printing machine as in claim 1 wherein a forme cylinder and at least one impression cylinder of a double-printing assembly are moveable in said slides, the other forme cylinder being non-moveable.

6. A web-fed rotary printing machine as in claim 5 further comprising a frame, wherein one of said ends of each said forme cylinder is a driving end and the other end is an operating end, said driving ends of said non-moveable forme cylinders being mounted in bearing blocks fastened to the frame, said operating ends of said non-moveable forme cylinders being mounted in slides moveable horizontally on straight guide elements fastened to said frame, said non-moveable forme cylinders each being provided with a coupling for decoupling said driving end from said operating end.

7. A web-fed rotary printing machine as in claim 1 wherein at least one of said forme cylinders carries one of an intaglio printing forme onto which an intaglio inking assembly can be thrown, and a flexographic printing forme onto which a flexographic inking assembly can be thrown.

8. A web-fed rotary printing machine as in claim 7 wherein said forme cylinder carries a sleeve-shaped printing forme which can be exchanged for a sleeve-shaped printing forme having a different outside diameter.

9. A web-fed rotary printing machine as in claim 7 wherein said forme cylinder carries a cylinder body which carries a sleeve-shaped printing forme, said cylinder body being exchangeable for a cylinder body having a different outside diameter.

10. A web-fed rotary printing machine as in claim 1 wherein said impression cylinder carries one of an elastic sleeve and an inelastic sleeve.

11. A web-fed rotary printing machine as in claim 1 wherein said web can be guided approximately horizontally through a first printing position between one of said forme cylinders and one of said impression cylinders in a first web running direction, and can be guided approximately horizontally through a second printing position between the other of said forme cylinders and one of said impression cylinders in a second web-running direction which is opposite to said first web running direction, said machine further comprising guide rollers for deflecting said web from said first direction to said second direction.

12. A web-fed rotary printing machine as in claim 9 comprising two said double printing assemblies arranged one above the other, said machine further comprising guide rollers for guiding said web emerging from one of said printing assemblies in said second direction and deflecting said web into the other one of said printing assemblies in said first direction.

13. A web-fed rotary printing machine as in claim 11 further comprising a drying device directed toward a printed side of the web downstream of each said printing position.

14. A web-fed rotary printing machine as in claim 11 further comprising web-winding devices suitable for winding and unwinding a web arranged at at least one of upstream and downstream of the printing units.

15. A web-fed printing machine as in claim 1 wherein each said printing assembly comprises an inking assembly which is moveable in the direction of the guide elements.

16. A web-fed printing machine as in claim 1 wherein each said printing assembly comprises an inking assembly which is moveable in an approximately horizontal direction with respect to the forme cylinder.

17. A web-fed rotary printing machine as in claim 1 wherein each said forme cylinder has an outside diameter which can be changed.

18. A web-fed rotary printing machine as in claim 1 comprising two said double printing assemblies arranged one above the other, said forme cylinders of said printing assemblies having axes which lie in a common plane.

19. A web-fed rotary printing machine as in claim 18 wherein each said double printing assembly comprises a single impression cylinder having an axis in said common plane.

20. A web-fed rotary printing machine as in claim 18 wherein one of said forme cylinders in each said double printing assembly is moveable in a direction parallel to said plane.

* * * * *